United States Patent [19]

Beck et al.

[11] 4,142,747

[45] Mar. 6, 1979

[54] DOUBLE-LOCKING ASSEMBLY FOR SLIDING GLASS CLOSURES

[76] Inventors: Robert W. Beck, 1406 S. Spruce; John S. Duarte, 1410 S. Spruce, both of Santa Ana, Calif. 92704

[21] Appl. No.: 828,348

[22] Filed: Aug. 29, 1977

[51] Int. Cl.[2] ..... E05C 9/04; E05C 9/14

[52] U.S. Cl. ..... 292/37; 292/40; 292/DIG. 51; 292/DIG. 53

[58] Field of Search ..... 292/37, 40, 33, 32, 292/34, 36, DIG. 46, DIG. 51, DIG. 55, DIG. 64, 244, 357, DIG. 53

[56] References Cited

U.S. PATENT DOCUMENTS

| | | | |
|---|---|---|---|
| 724,521 | 4/1903 | Teeter | 292/37 |
| 1,524,556 | 1/1925 | Kennedy | 292/33 X |
| 1,865,205 | 6/1932 | Palmquist | 292/37 |
| 2,216,335 | 10/1940 | Ashton | 292/40 |

FOREIGN PATENT DOCUMENTS

| | | | |
|---|---|---|---|
| 2404575 | 8/1974 | Fed. Rep. of Germany | 292/33 |
| 729459 | 4/1937 | France | 292/40 |
| 970976 | 6/1950 | France | 292/33 |
| 190669 | 7/1937 | Switzerland | 292/40 |
| 23602 | 10/1902 | United Kingdom | 292/40 |

*Primary Examiner*—Roy D. Frazier
*Assistant Examiner*—William E. Lyddane

[57] ABSTRACT

A double-locking assembly for sliding glass closures is described. The assembly uses a pair of locking rods which are moved axially to engage stops in a casing around the closure by a single-action rotation of a cammed actuator which is mounted on the frame surrounding the glass.

2 Claims, 9 Drawing Figures

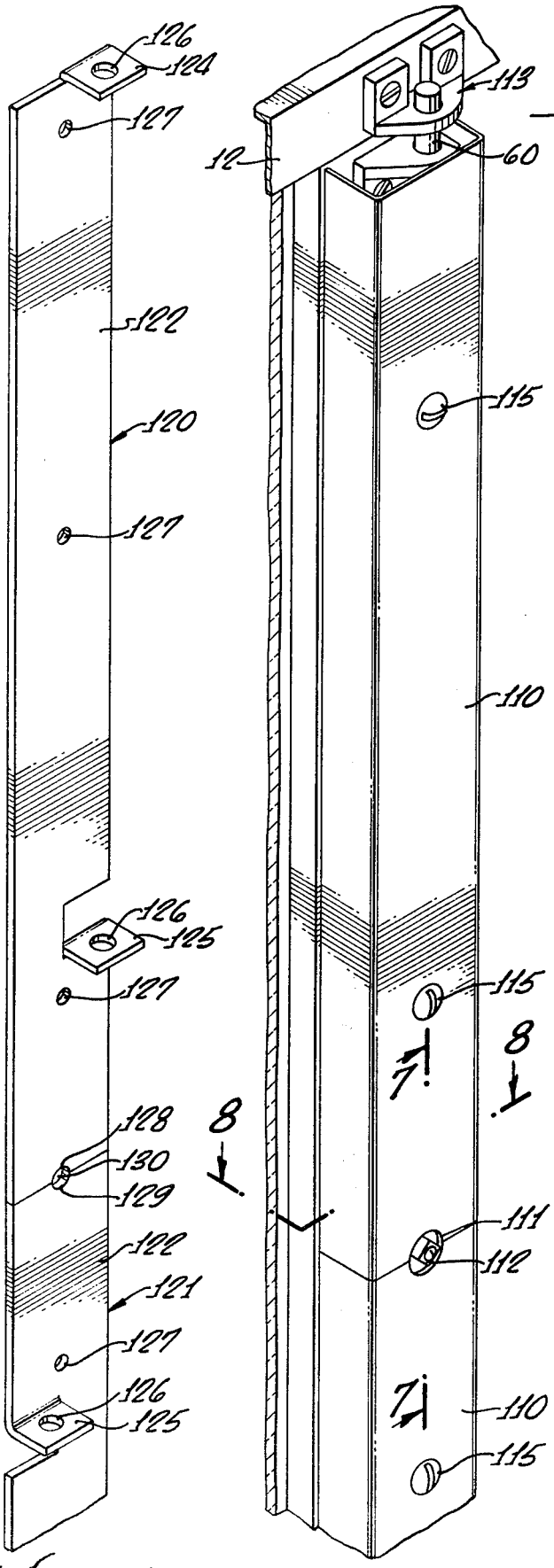
FIG. 6.
FIG. 9.
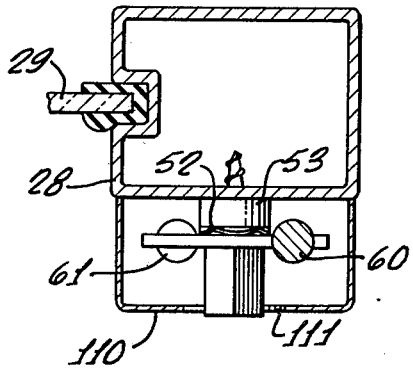
FIG. 8.
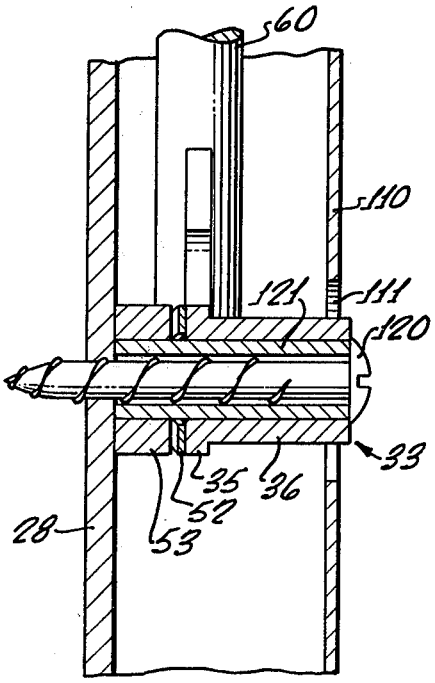
FIG. 7.

DOUBLE-LOCKING ASSEMBLY FOR SLIDING GLASS CLOSURES

BACKGROUND OF THE INVENTION

1. Field of the Invention

This invention relates to locks for closures, especially locks for horizontally sliding closures. More particularly, it relates to devices for double-locking sliding glass doors and windows to prevent their being opened from the outside.

2. Description of the Prior Art

The positioning of rods across the inside of a door to anchor it to a door frame for preventing unauthorized opening from the outside is known. For example, diagonal sliding bolts have been suggested for locking car doors in U.S. Pat. No. 1,335,192. It has been suggested in U.S. Pat. No. 2,854,708 to lock a series of sliding doors together by sliding and bending a rod from one door to wedge against the next one. It is also known to lock garage-type, vertically sliding and folding doors by using bolts which run horizontally across the inside of the door to engage stops in the frame of the building, as shown, for example, in U.S. Pat. No. 3,187,526. Such locks would be visible from the outside if used on glass doors. This is undesirable because it enables a potential intruder to see them and attempt to circumvent the locking means. Locks for burglar-proofing wood or metal swinging doors involving the use of vertical rods are shown in U.S. Pat. No. 3,255,618 and vertical locking rods are also shown built into the structure of a door in U.S. Pat. No. 2,969,666.

In general, these prior art devices suffer deficiencies which render them either too unsophisticated or unesthetic for use with doors and windows in a dwelling place or too complicated for the average homeowner to personally install. Some prior art devices also have many overly sophisticated parts which render their production and installation expensive or they use large parts which are inconvenient for reasonable storage and handling.

It has thus long been felt desirable to provide the art with an inexpensive locking device for sliding glass doors and windows which could be installed by any average person, without any significant mechanical skill. For security and ease of operation, such devices must be designed to double-lock the closure and yet achieve that result with a single locking action. This could be partially achieved using something like the device shown in U.S. Pat. No. 3,255,618 if the cam plate assembly shown therein were somehow reduced in size, e.g., as in the devices shown in U.S. Pat. Nos. 2,969,666 and 2,317,312, to fit on the frame of a typical glass closure. Those devices do provide a double-locking arrangement by a single rotary action of a cam which drives bolts into stops in a surrounding frame. Such devices, however, leave room for improvement. For example, when locking rods or bolts are connected to a rotatable cam plate, as shown in U.S. Pat. Nos. 3,255,618, 2,969,666, or 2,317,312, they not only move axially when the cam is rotated, but they also move transverse to their axes. Even providing a bent section in the rods, as shown in U.S. Pat. No. 2,317,312, cannot eliminate such sideways motion, and it necessarily renders the devices more expensive and complicated to make and assemble.

The presence of transverse motion means that the locking rods must be used with oversized guide brackets to allow for their sideways motion. Oversized brackets result in loose fit of the rods in the brackets, which, in turn, makes it impossible to assure alignment of the rods with their corresponding stops in the casing of the door or window, unless the stop openings are also oversized. However, if stop openings are oversized, i.e., significantly larger than the locking rods, free play in the entire system inherently results. Such free play is not only crude and unattractive, but it may also permit the closure to slide sufficiently for an intruder to insert a tool to cut the locking rods or shake loose, or otherwise circumvent, the lock.

Another problem which makes prior art devices unsuitable for homeowner installation is the complexity of the techniques needed for positioning the guides for the locking rods. If close fitting guides are used, they must be positioned perpendicularly to the rods to keep the rods from binding when the move through the guides. This problem is aggravated if there is any significant transverse rod movement. But even without such movement, a problem exists when the rod motion is slightly angled from the vertical as, e.g., with the type of lock shown in U.S. Pat. No. 2,969,666. Without a great deal of mechanical aptitude, the average homeowner would simply have to use trial and error techniques to position the guide brackets at the correct degree of tilt from the vertical and at the correct distance from the actuator to guide the rods smoothly. Such need for trial and error installation techniques is obviously an unsuitable selling point for a locking assembly, even aside from the fact that each trial installation defaces the closure frame.

Thus there has been a long felt need for a double-locking assembly for sliding glass closures which can use straight, rigid locking rods positioned to move vertically through guide brackets without any significant transverse component of motion. For simplicity of homeowner installations, a need also exists for such assemblies that are capable of installation without trial and error and without the need for complex positioning measurements. It would also be desirable to use a minimum number of different shapes of parts to simplify the manufacture, storage, distribution and installation of the locking assemblies.

SUMMARY OF THE INVENTION

This invention contemplates an improved lock means for sliding closures, especially for horizontally sliding doors and windows having glass panes or panels. The lock means includes upper and lower elongated locking rods having at least one guide means for each rod, actuator means adapted to be attached to one end of each of the locking rods, and means for securing the locking rods, guide means, and actuator means to an inside surface of the frame of the window or door.

The locking rods are adapted to be vertically positioned in a horizontally spaced-apart relationship parallel to one another in a plane parallel to the surface of the frame to which they are to be attached, with the upper locking rod extending upwardly from the actuator means toward the top of the frame and the lower locking rod extending downwardly from the actuator means toward the bottom of the frame.

The guide means for the upper and lower locking rods are fastened to the frame and have apertures adapted to fit the rods. Preferably, the upper and lower guide means are identical and are adapted such that when the upper guide means is positioned in vertically reversed orientation with respect to the lower guide means, their edges can be substantially in vertical alignment with each other while their apertures are off-set sufficiently to be aligned with the spaced-apart locking rods.

The actuator means includes a pivot means which is adapted to simultaneously move the upper and lower locking rods vertically in opposite directions by partially rotating the pivot means about its point of attachment to the frame of the closure. With the closure in closed position, the pivot means can be rotated to extend the locking rods such that they engage stops which are provided in the door or window casing, to double-lock the closure. By reversing the rotation of the pivot means, the rods are simultaneously retracted and disengage from the stops, to unlock the closure.

BRIEF DESCRIPTION OF THE DRAWINGS

FIG. 6 shows, in perspective, a cover for the lock assembly installed on a sliding glass window;

FIG. 7 is a sectional view taken along line 7—7 of FIG. 6;

FIG. 8 is a sectional view taken along line 8—8 of FIG. 6, and

FIG. 9 shows a perspective view of a pair of guide bracket plates having multiple working portions and apertures.

DESCRIPTION OF THE PREFERRED EMBODIMENTS

Figure 1:
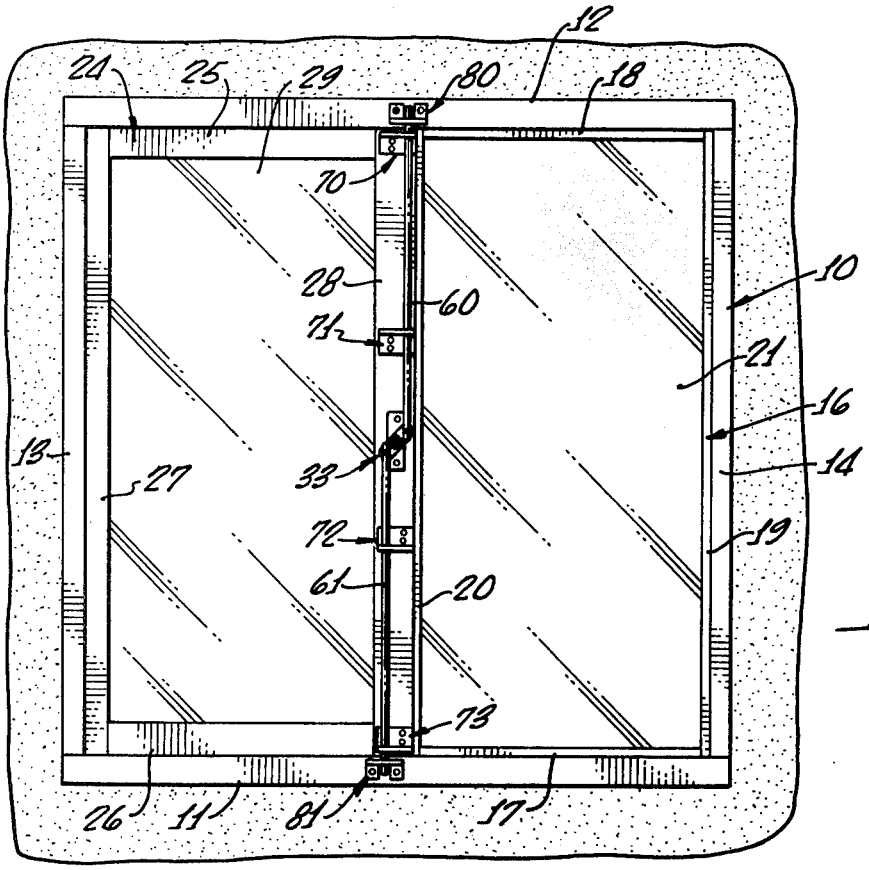
FIG. 1 is a frontal view of a window with double locks, looking from the inside.

FIG. 1 shows a casing 10, consisting of a base member 11, a top member 12, and side members 13 and 14, installed in the wall of a building (not shown). Window frame 6, consisting of a lower rail 17, an upper rail 18 and stiles 19 and 20, encases glass window pane 21 and is permanently secured in a fixed position inside casing 10. Along the other side of the casing 10 is a slidable closure 24 consisting of an upper rail 25, a lower rail 26, stiles 27 and 28 and a glass window pane 29 secured therein. Closure 24 is positioned so that it can slide horizontally just in front, or on the inner side, of fixed pane 21.

FIG. 1 shows slidable closure 24 moved all the way to the left or closed position and double-locked in that position. The operation of the double-locking assembly can be described briefly as follows: rotation of the actuator assembly 33 extends or retracts locking rods 60 and 61 simultaneously through guide brackets 70, 71, 72 and 73 to engage or disengage from stops 80 and 81, which are mounted on bottom and top members 11 and 12 of window casing 10.

Figure 2:
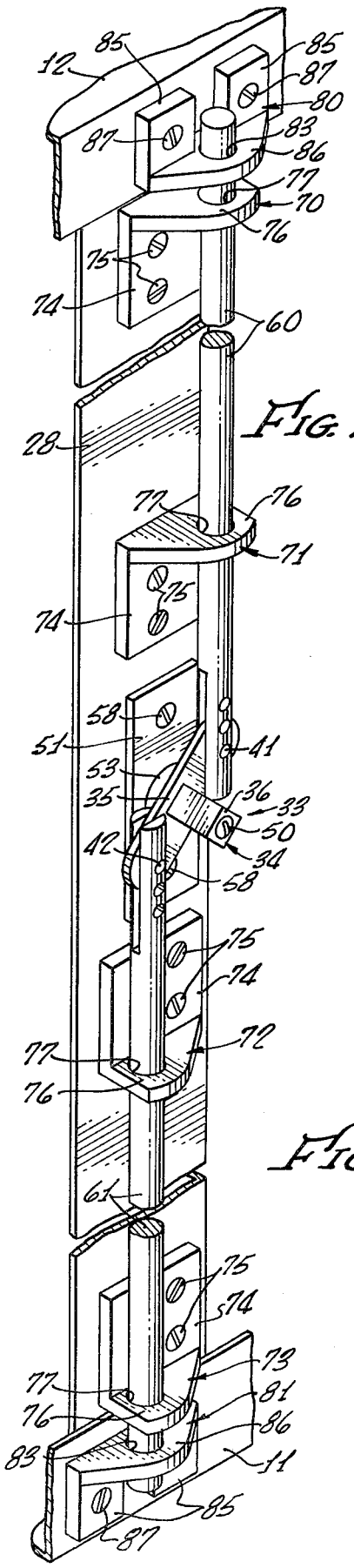
FIG. 2 shows a partially cut-away perspective of the lock assembly of FIG. 1, showing the locking rods in fully extended or locked position.
Figure 3:
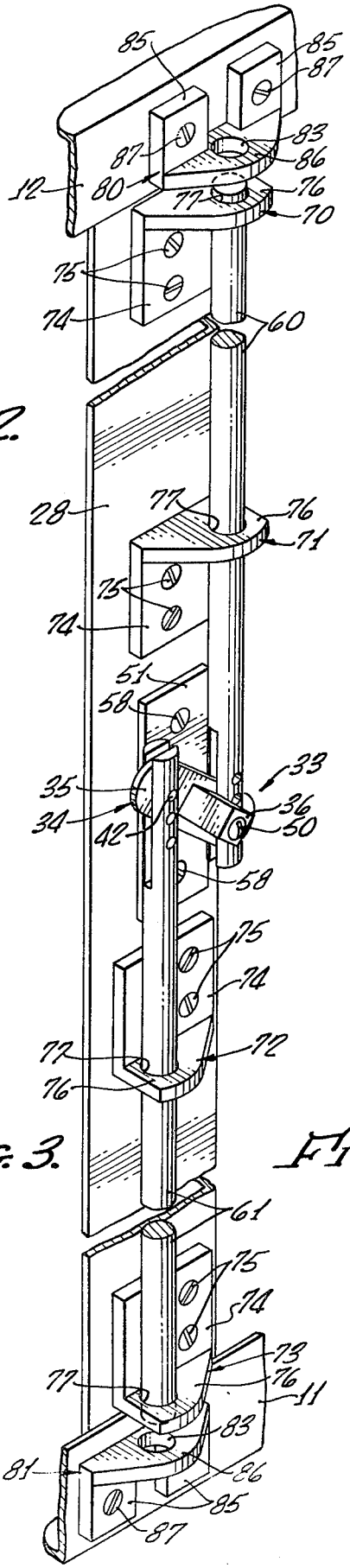
FIG. 3 is a similar view with the locking rods in retracted or unlocked position.

FIGS. 2 and 3 illustrate in enlarged detail the double-lock assembly of FIG. 1. FIG. 2 shows the actuator assembly 33 whose pivot member 34 is rotated counter-clockwise so that the locking rods 60 and 61 are fully extended and engaged in stops 80 and 81. FIG. 3 shows the locking rods 60 and 61 in retracted position after being disengaged from stops 80 and 81 by the clockwise rotation of pivot member 34.

Figure 4:
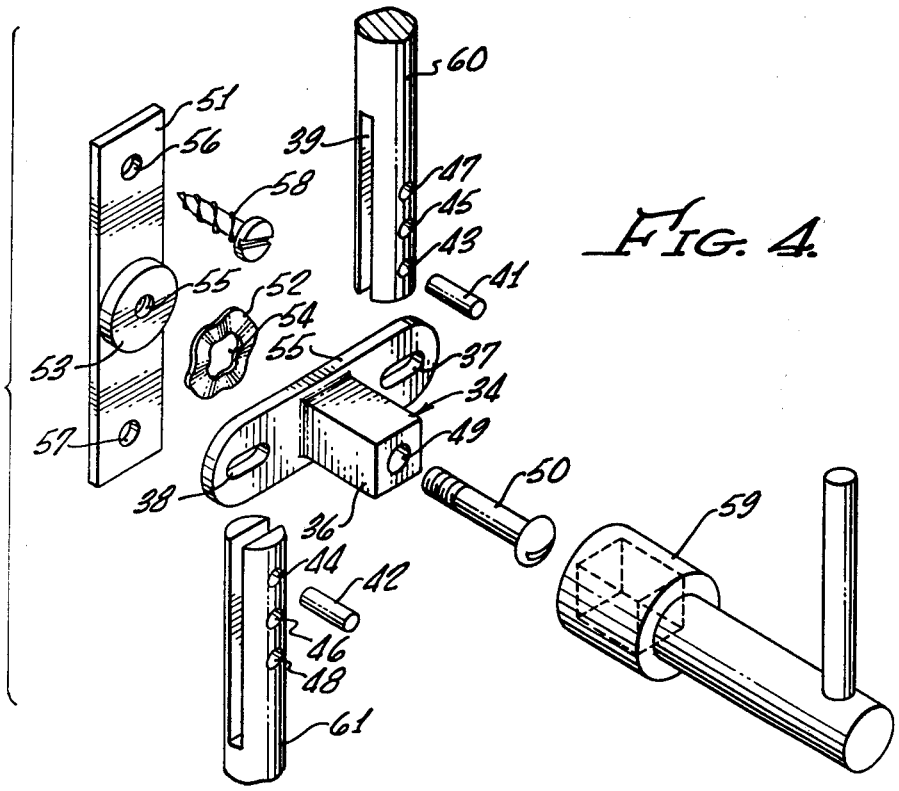
FIG. 4 is an exploded perspective showing the various components of the actuator means and linking means for connecting the actuator means to the locking rods.

Actuator assembly 33 is shown in exploded perspective in FIG. 4. Therein is shown pivot member 34 having an elongated rocker 35 and a rectangular spindle 36. The elongated rocker 35 includes cam slots 37 and 38 to link the rocker with locking rods 60 and 61. The operating rods 60 and 61 have end slots 39 and 40, respectively, sized to slip freely over the ends of elongated rocker 35, where they are linked in position by inserting pins 41 and 42 through holes 43 and 44 of the locking rods and cam slots 37 and 38 of elongated rocker 35.

Alternatively, locking rod 60 can be hinged to cam slot 37 by inserting pin 41 through either of holes 45 or 47, and locking rod 61 can be hinged to cam slot 38 by inserting pin 42 through either of holes 46 or 48. The extra holes in the locking rods are provided to offer flexibility in the precise positioning of the rods to fit windows of varying heights. The particular holes used are selected to insure that when the locking rods are in retracted position, they are completely disengaged from stops 80 and 81, and when they are in fully extended position, they are securely engaged with the stops.

Pivot member 34 also defines a hole 49 extending axially through both the rectangular spindle 36 and the elongated rocker 35. A machine screw 50 is inserted through hole 49 and secured to a threaded base plate 51. A wavy spring washer 52 and a spacer 53 having apertures 54 and 55, respectively, are positioned on machine screw 50 between pivot member 34 and base plate 51.

The function of wavy spring washer 52 is to provide sufficient friction to prevent any accidental or undesired motion of the pivot member 34 and locking rods 60 and 61. Thus, for example, if an intruder attempts to jar the locking rods loose from the outside, the friction imparted by wavy spring washer 52 will maintain them in locked position.

Spacer 53 has a thickness designed to keep pivot member 34 and locking rods 60 and 61 away from the surface of stile 28 and in vertical alignment with guide means 70, 71, 72 and 73.

The entire actuator assembly 33 is secured to stile 28 by fasteners, such as screw 58, through apertures 56 and 57.

Key 59 is designed to engage spindle 36 of pivot member 34 for locking and unlocking the window. When the spindle is rotated, the resulting axial movement of the locking rods is controlled and guided by guide brackets 70, 71, 72 and 73, positioned along stile 28. Generally it is preferred to use at least two guide brackets for each locking rod; however, for short stiles a single bracket at the top and another at the bottom of the stile will be adequate.

Each guide bracket has a base portion 74 which is secured to stile 28 by fasteners 75 through apertures (not shown) in base portion 74. A working portion 76, having an aperture 77, extends horizontally outwardly from each base portion 74. The apertures 77 are sized to engage and guide upper and lower locking rods 60 and 61 and to maintain them in vertical orientation, permitting the rods to move axially but not transversely with respect to the brackets. When wooden stiles are used, either nails or wood screws may be used for fasteners 75. When metal stiles, such as aluminum, are used, it is preferred to use sheet metal screws to fasten the guide brackets 70, 71, 72 and 73 to the stile 28.

When pivot member 34 is rotated counterclockwise until locking rods 60 and 61 are in fully extended position, as shown in FIG. 2, the rods extend through and engage apertures 83 of stops 80 and 81, respectively. Each of stops 80 and 81 has base portions 85 and a working portion 86 which houses aperture 83. The stops 80 and 81 may have a structure similar to that of guide brackets 70, 71, 72 and 73, or they may have a different structure, such as that shown in FIGS. 2 and 3. The stops are fastened by fasteners 87 to the bottom and top members 11 and 12 of casing 10. Generally aluminum or steel are preferred materials for the actuator assembly, locking rods, brackets and stops; however, any similarly strong material can be used.

To unlock the double-lock assembly, pivot member 34 is rotated clockwise, as shown in FIG. 3, and the locking rods 60 and 61 are simultaneously retracted from apertures 83 of stops 80 and 81 so that the window is released and can slide into open position.

The double-lock assembly is designed for easy installation which can be accomplished by almost anyone, without any significant mechanical skill. In the embodiments shown in FIGS. 2 and 3, installation is especially simplified. For example, the homeowner or installer need merely align the various guide brackets 70, 71, 72 and 73. This can be readily achieved by aligning the edge of each of the brackets with the edge of the stile 28, or alternatively, a straight edge can be used and a line can be drawn along the stile to position the brackets. In the embodiment shown, it is particularly noteworthy that the upper guide brackets 70 and 71 are identical in structure to lower guide brackets 72 and 73. The aperture 77 in the working portion 76 is offset horizontally from the axis of the base portion 74 of each bracket. This makes it possible to use brackets of identical structure for both upper and lower locking rods by simply reversing the vertical orientation of the bottom ones with respect to the top ones. In other words, when installed properly, the top edge of an upper guide bracket (70 or 71) will correspond with the bottom edge of a lower guide bracket (72 or 73). Thus it is impossible for the installer to install an incorrect bracket for a particular locking rod. The only requirement is that apertures of the upper brackets line up with one another, and the apertures of the lower brackets line up with one another (but not with those of the upper brackets). If the corresponding apertures do not line up, the installer will immediately recognize that one or more brackets are reversed in their orientation and need merely rotate the out-of-place brackets by 180°. The brackets are installed by drilling starting holes at appropriate points in the stile, and then fastening the bracket to the stile with screw fasteners. (When nails are used in wood stiles, they can be simply driven into position with or without using starter holes.) After the brackets are installed, the installer may then insert upper locking rod 80 and pin it to cam slot 37 of elongated rocker 35. The lower locking rod 81 can then be similarly positioned and installed.

After the locking rods are attached to elongated rocker 35, the rocker and the other components of the actuator assembly 33 are assembled as shown in FIG. 4, and the base plate 51 is then secured to stile 28 with fasteners 58. Pivot means 34 is then rotated counterclockwise until the locking rods 60 and 61 are in fully extended position. The upper and lower stops can then be positioned over the rods and fastened with fasteners 87 to the bottom member 11 and top member 12 of casing 10.

For some uses the actuator assembly 33 can be even further simplified by omitting base plate 51 and simply installing spacer 53 and wavy spring washer 52 together with the pivot member 34 by substituting a pointed screw for machine screw 50. The actuator components can then be fastened directly to the stile 28, as illustrated in FIG. 7.

An important feature in the optimum performance of the lock assembly is provided by the cam slots 37 and 38 in the elongated rocker 35, shown in detail in FIG. 4. The function of the cam slots is to translate the rotary motion of pivot member 34 into a pure vertical motion of locking rods 60 and 61. This is achieved by providing sliding hinged connections between elongated rocker 35 and locking rods 60 and 61, using pins 41 which are sufficiently small to allow them to slide freely across cam slots 37 and 38. Thus, when the rocker is rotated, the cam slots move in a rotary motion having both vertical and horizontal components; however, pins 41 and 42 are permitted to remain horizontally stationary by sliding in the cam slots while they move upwardly or downwardly, driving the locking rods 60 and 61 in vertical directions.

The elimination of the transverse component of motion permits the locking rods to move smoothly through the various guide brackets and stops without binding, irrespective of the distance between the actuator assembly and the guide brackets. Moreover, it permits guide brackets and stops to be used having apertures sized very close to the size of the locking rods, which, it turn, makes it possible to eliminate any slack space that would detract from the appearance, security and effectiveness of the double-locking apparatus.

It is preferred that the cam slots be oriented in the rocker such that they are horizontal when the rocker is in mid-position, i.e., when the locking rods are halfway between fully extended and fully retracted positions. So oriented, the cam slots will contribute maximum axial motion to the rods for a given amount of rocker rotation.

Figure 5:
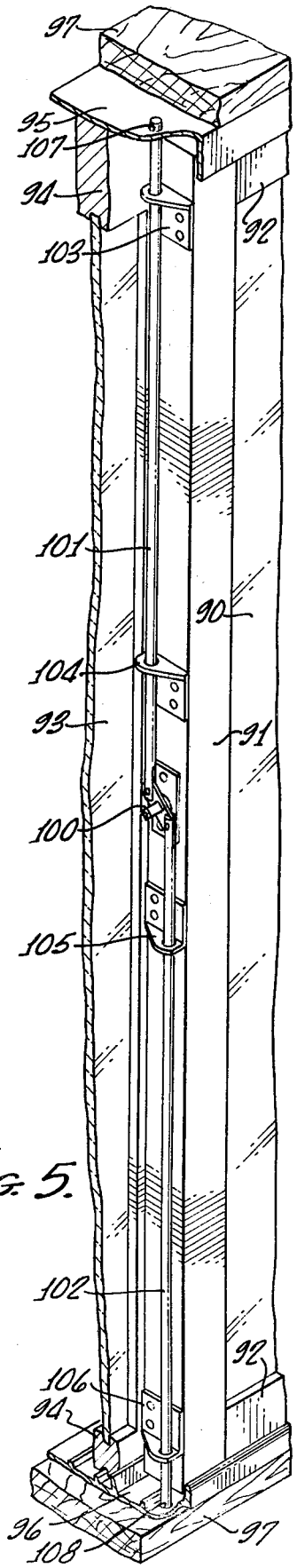
FIG. 5 shows a partially cut-away perspective of a double lock assembly installed along the edge of a sliding glass window perpendicular to the pane.

FIG. 5 shows an alternative arrangement contemplated by this invention in which the various components of the lock assembly are positioned along the end of a stile perpendicular to the window pane. Therein is shown a window pane 90 slidably framed by a stile 91 and upper and lower rails 92 and positioned for sliding in front of fixed pane 93, which is also framed by a stile (not shown) and upper and lower rails 94.

Both framed panes are mounted in an upper aluminum channel 95 and lower aluminum channel 96, which channels are mounted in an outer wooden casing 97.

FIG. 5 shows the lock assembly in double-locked position with the slidable window closed. The locking has been achieved by rotating spindle 100 clockwise to simultaneously move upper and lower locking rods 101 and 102 through guide brackets 103, 104, 105 and 106, to a fully extended position.

In the fully extended position, locking rods 101 and 102 extend through and engage apertures 107 and 108, which are provided in the channels 95 and 96, to securely lock the window in closed position. To unlock the window, one merely rotates spindle 100 counterclockwise (using a means such as key 59) to withdraw the locking rods from engagement with apertures 107 and 108.

When the double-lock assembly is installed along the end of the stile, as shown in FIG. 5, it may be desirable to cover the components to prevent a potential intruder from seeing them from outside the window. It may also be desirable to cover the components for aesthetic reasons when they are installed on the inner side of the stile, as shown in FIGS. 2 and 3. FIG. 6 illustrates a simple and inexpensive means for covering the double-lock assembly. Therein is shown a cover 110 which is shaped to form a channel of a sufficient width and depth to cover the various components of the locking assembly. The channel can be a single member sufficiently long to extend from the top to the bottom of the stile. Alternatively, the channel may be composed of two or more smaller members which can be installed abutting one another along the stile. A hole 111 is provided in the cover sufficient in size for the insertion of a key to turn spindle 112 to actuate the locking rods to engage upper stop 113 and a lower stop (not shown).

The covers can be made from any suitable material such as plastic or extruded aluminum channels. Since they bear no weight other than their own, any convenient means may be used to support them on the stile. In FIG. 6 it is contemplated that screw fasteners 115 will be inserted through the cover 110 and screwed into the wall of the stile beneath (not shown).

FIGS. 7 and 8 show sections taken along lines 7—7 and 8—8 of FIG. 6 and illustrate the use of a channel cover over the locking assembly components for an arrangement such as that shown in FIGS. 2 and 3. In FIG. 7 there is shown the channel cover 110 covering upper locking rod 60 (the lower locking rod is not shown). FIG. 7 also shows a variation of the means for attaching the actuator assembly. In the variation shown, machine screw 50 (as shown in FIG. 4) has been replaced by a sheet metal screw 120, which is screwed directly into stile 28, thus eliminating the need for a base plate such as plate 51. This screw 120 is inserted through spindle 36 and elongated rocker 38 of pivot means 34 and through wavy spring washer 52 and spacer 53 similar to the manner in which the components were assembled in FIG. 4. However, there is also included a bushing 121 which is placed around the screw 120 and inside the various components of the actuator assembly. The length of bushing 121 is predetermined to prevent over-tightening of screw 120 (which would make it unduly difficult to rotate the pivot means 34) while insuring that the wavy spring washer 52 can be sufficiently compressed to provide necessary friction and prevent undesirable looseness in the rotary action of the actuator assembly components.

FIG. 9 shows another embodiment for the guide brackets used in the double-lock assembly. In this embodiment strips of appropriate metal, such as aluminum, are preformed into unitary guide bracket plates 120 and 121, each of which has base portions 122 and working portions 124 and 125. The working portions have apertures 126 to receive the locking rods (not shown). The base portions have one or more apertures 127 to receive fasteners for securing the guide bracket plates to a window or door stile.

A single, long guide bracket plate can be prepared to cover an entire stile; however, it is generally more desirable to use two bracket plates of identical structure abutting each other in reversed orientation as shown in FIG. 9. The abutting ends of the two plates 120 and 121 have notches 128 and 129 which form an aperture 130 when they are placed together. The aperture 130 is sized to encompass a fastener such as screw 120 (shown in FIG. 7). The embodiment of the guide brackets shown in FIG. 9 is especially useful for homeowner installation since it is particularly easy to align the long bracket plates along the stile, and there is virtually no possibility of making a mistake in the initial orientation of the components along the stile.

Although specific details have been provided for the preferred embodiments of the invention disclosed herein, it will be apparent to those skilled in the art that many operable variations are possible. For example, while the various locking rods and apertures shown in the drawings are circular in cross-section, it will be apparent that other shapes may be used. Also, it is contemplated that the double-locking means described can be used on various types of sliding doors as well as windows, without departing from the bounds of the invention, and it is intended that the invention be limited solely by the attached claims.

We claim:

1. In a closure assembly having, in combination, a casing, a closure fitted within said casing adapted for opening and closing by sliding horizontally, said closure including a glass portion and a rectangular frame consisting of horizontal rails and vertical stiles around said glass portion, the improvement comprising:

(a) an actuator means attached to the inner side of a stile of said frame;

(b) an upper locking rod operatively connected to the actuator means and vertically aligned along said stile and extending from said actuator means upwardly toward the top portion of said casing;

(c) a lower locking rod operatively connected to the actuator means and vertically aligned along said stile and extending from said actuator means downwardly toward the bottom portion of said casing;

said upper and lower rods being positioned so that their axes are horizontally spaced apart from each other and lie in a plane parallel to the surface of said inner side of said stile;

(d) at least one upper guide means affixed to said inner side of said stile above said actuator means, said upper guide means being adapted to prevent transverse motion and to permit axial motion of said upper locking rod;

(e) at least one lower guide means affixed to said inner side of said stile below said actuator means, said lower guide means being adapted to prevent transverse motion and to permit axial motion of said lower locking rod, each of said upper and lower guide means being identical in structure and positioned in opposite vertical orientation along said stile such that the upper edge of said upper guide means corresponds structurally with the lower edge of said lower guide means, each of said guide means comprising an L-shaped structure having a planar base portion affixed to said stile and a working portion connected to said base portion and extending perpendicularly away from said base portion, said working portion having an aperture adapted to permit its corresponding locking rod to slide axially therethrough without significant transverse movement when said rod is moved by said actuator means, said aperture having a vertical axis lying in a plane which is perpendicular to said base portion and horizontally spaced apart from the vertical axis of said base portion, said corresponding locking rod being positioned through said aperture, and the base portion of each of said guide means being sized such that when said actuator means is affixed to the stile at a position half way between the top and bottom edge of the stile, one end of the base portion of each said guide means is substantially abutting said actuator means and the base portion of the upper and lower guide means extend vertically along said stile such that the other ends of said base portions are substantially at the top and bottom edges, respectively, of said stile;

(f) an elongated fastener adapted to extend from said actuator means into said stile to secure said actuator means to said stile, and the base portions of said guide means are notched at the middle of the ends abutting said actuator means, such that when the upper and lower guide means are fastened to said stile, said notched ends abuts one another to form an aperture between them which encompasses said elongated fastener, (g) an upper stop provided at the upper portion of said casing vertically aligned with said upper locking rod and adapted for engagement therewith when said closure is closed, and (h) a lower stop provided at the lower portion of said casing vertically aligned with said lower locking rod and adapted for engagement therewith when said closure is closed, said actuator means being adapted to impart solely axial motion simultaneously to the upper and lower locking rods to move them vertically in opposite directions such that when the upper locking rod extends upwardly it engages the upper stop and said lower locking rod simultaneously extends downwardly and engages the lower stop whereby the closure is double-locked, and when said upper locking rod retracts downwardly it disengages from the upper stop and said lower locking rod simultaneously retracts upwardly and disengages from said lower stop whereby said closure is unlocked.

2. A closure assembly as recited in claim 1 wherein said base portion has at least two of said working portions connected thereto, spaced apart from each other.

* * * * *